US009739240B2

(12) United States Patent
DiDonato, Jr. et al.

(10) Patent No.: US 9,739,240 B2
(45) Date of Patent: Aug. 22, 2017

(54) EGR DEVICE IN INTAKE MANIFOLD

(71) Applicants: DENSO International America, Inc., Southfield, MI (US); DENSO CORPORATION, Kariya, Aichi-pref. (JP)

(72) Inventors: Blaise DiDonato, Jr., Waterford, MI (US); Mark Williams, Gaines, MI (US); Robert Cardno, Novi, MI (US)

(73) Assignees: DENSO International America, Inc., Southfield, MI (US); DENSO CORPORATION, Kariya (JP)

( * ) Notice: Subject to any disclaimer, the term of this patent is extended or adjusted under 35 U.S.C. 154(b) by 364 days.

(21) Appl. No.: 14/541,549

(22) Filed: Nov. 14, 2014

(65) Prior Publication Data

US 2016/0138525 A1 May 19, 2016

(51) Int. Cl.

| | |
|---|---|
| ***F02M 26/10*** | (2016.01) |
| ***F02M 26/19*** | (2016.01) |
| ***F02M 26/06*** | (2016.01) |
| *F02M 26/23* | (2016.01) |

(52) U.S. Cl.

CPC ..... *F02M 26/10* (2016.02); *F02M 26/06* (2016.02); *F02M 26/19* (2016.02); *F02M 26/23* (2016.02)

(58) Field of Classification Search

CPC ..... F02M 26/10; F02M 26/06; F02M 26/19; F02M 26/23

See application file for complete search history.

(56) References Cited

U.S. PATENT DOCUMENTS

| | | | | |
|---|---|---|---|---|
| 4,327,698 | A * | 5/1982 | Hamai | F02M 33/06 123/568.17 |
| 4,811,697 | A * | 3/1989 | Kurahashi | F02B 75/22 123/184.35 |
| 5,666,930 | A * | 9/1997 | Elder | F01P 11/04 123/41.31 |
| 6,173,701 | B1 | 1/2001 | Azuma | |
| 6,928,993 | B2 * | 8/2005 | Yu | F02M 26/19 123/568.17 |
| 7,568,340 | B2 * | 8/2009 | Marsal | F02M 26/19 123/568.17 |
| 8,033,714 | B2 * | 10/2011 | Nishioka | B01D 53/8631 137/888 |
| 2007/0271920 | A1 | 11/2007 | Marsal et al. | |
| 2010/0139617 | A1 * | 6/2010 | Akiyama | F02D 9/1055 123/337 |
| 2012/0180478 | A1 | 7/2012 | Johnson et al. | |

FOREIGN PATENT DOCUMENTS

| | | | |
|---|---|---|---|
| CN | 102748169 | A | 10/2012 |
| WO | 2013055361 | A1 | 4/2013 |

* cited by examiner

*Primary Examiner* — David Hamaoui

(57) ABSTRACT

A housing has an outer pipe, an inner pipe, and an EGR inlet. The inner pipe is located inside the outer pipe. The inner pipe defines an inner passage internally. The inner pipe defines an annular passage externally with the outer pipe. The EGR inlet defines an EGR channel therein to communicate with the annular passage. The inner pipe has an end surface defining a throttle passage extending circumferentially. The throttle passage communicates the annular passage with the inner passage radially inward. The throttle passage is narrow on a side of the EGR channel and is wide on an opposite side of the EGR channel.

10 Claims, 6 Drawing Sheets

EGR DEVICE IN INTAKE MANIFOLD

TECHNICAL FIELD

The present disclosure relates to an EGR device, which has a throttle passage, for an internal combustion engine of a vehicle.

BACKGROUND

A vehicle may be equipped with an exhaust gas recirculation system (EGR system). The EGR system is to reduce emission contained in exhaust gas discharged from an internal combustion engine. The EGR system may recirculate a part of exhaust gas into fresh/intake air to produce mixture gas containing recirculated exhaust gas and fresh/intake air. Recirculated exhaust gas may be unevenly mixed with fresh/intake air to reduce combustion efficiency of the engine consequently.

SUMMARY

The present disclosure addresses the above-described concerns.

According to an aspect of the preset disclosure, an EGR device comprises a housing having an outer pipe, an inner pipe, and an EGR inlet. The inner pipe is located inside the outer pipe. The inner pipe defines an inner passage internally. The inner pipe defines an annular passage externally with the outer pipe. The EGR inlet defines an EGR channel therein to communicate with the annular passage. The inner pipe has an end surface defining a throttle passage. The throttle passage communicating the annular passage with the inner passage radially inward. The throttle passage is narrow on a side of the EGR channel and is wide on an opposite side of the throttle passage from the EGR channel.

According to another aspect of the preset disclosure, an EGR device comprises a housing having an outer pipe, an inner pipe, and an EGR inlet. The inner pipe is located inside the outer pipe. The inner pipe defines an inner passage internally. The inner pipe defines an annular passage externally with the outer pipe. The EGR inlet defines an EGR channel therein to communicate with the annular passage. The housing includes an inlet housing and an outlet housing, which are abutted to each other to form a throttle passage, which is in a tubular shape and extends circumferentially. The throttle passage is located between the annular passage and the inner passage to communicate the annular passage with the inner passage radially inward therethrough. The throttle passage is narrow on a side of the EGR channel and is wide on an opposite side of the EGR channel.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION

First Embodiment

Figure 1:
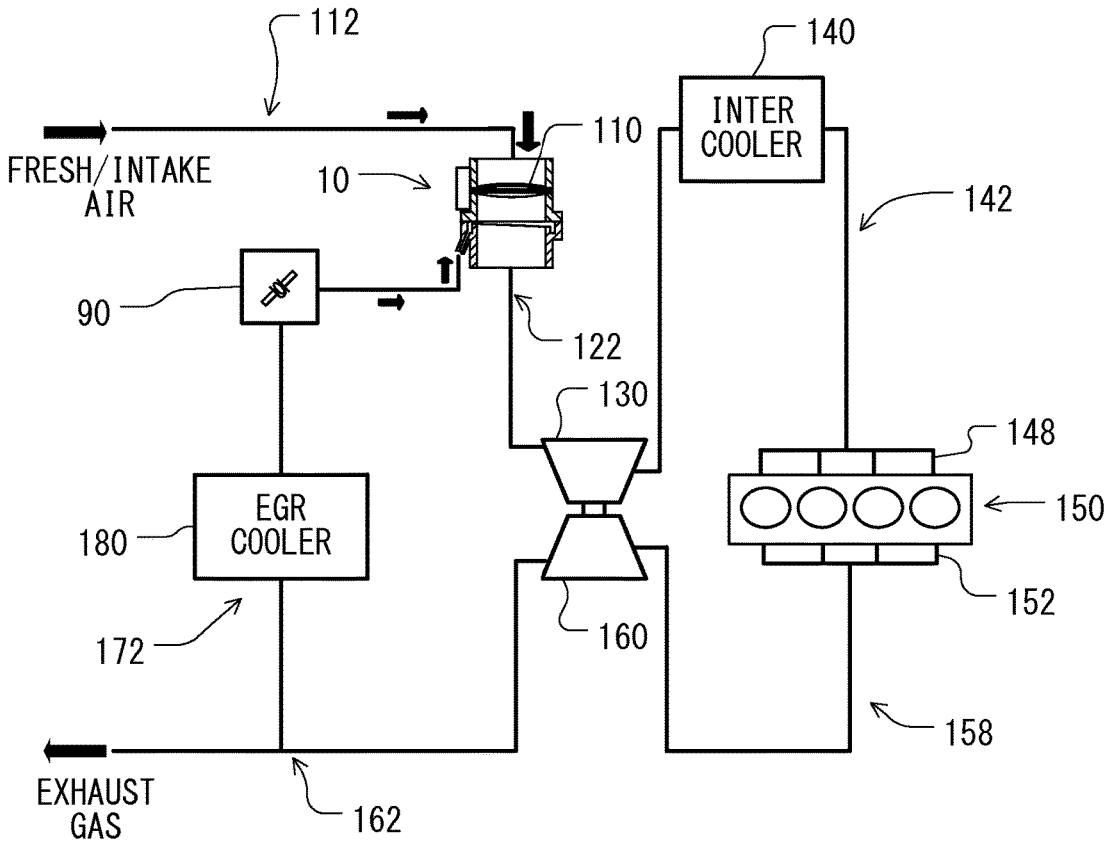
FIG. 1 is a block diagram showing an EGR system for an internal combustion engine of a vehicle.
Figure 2:
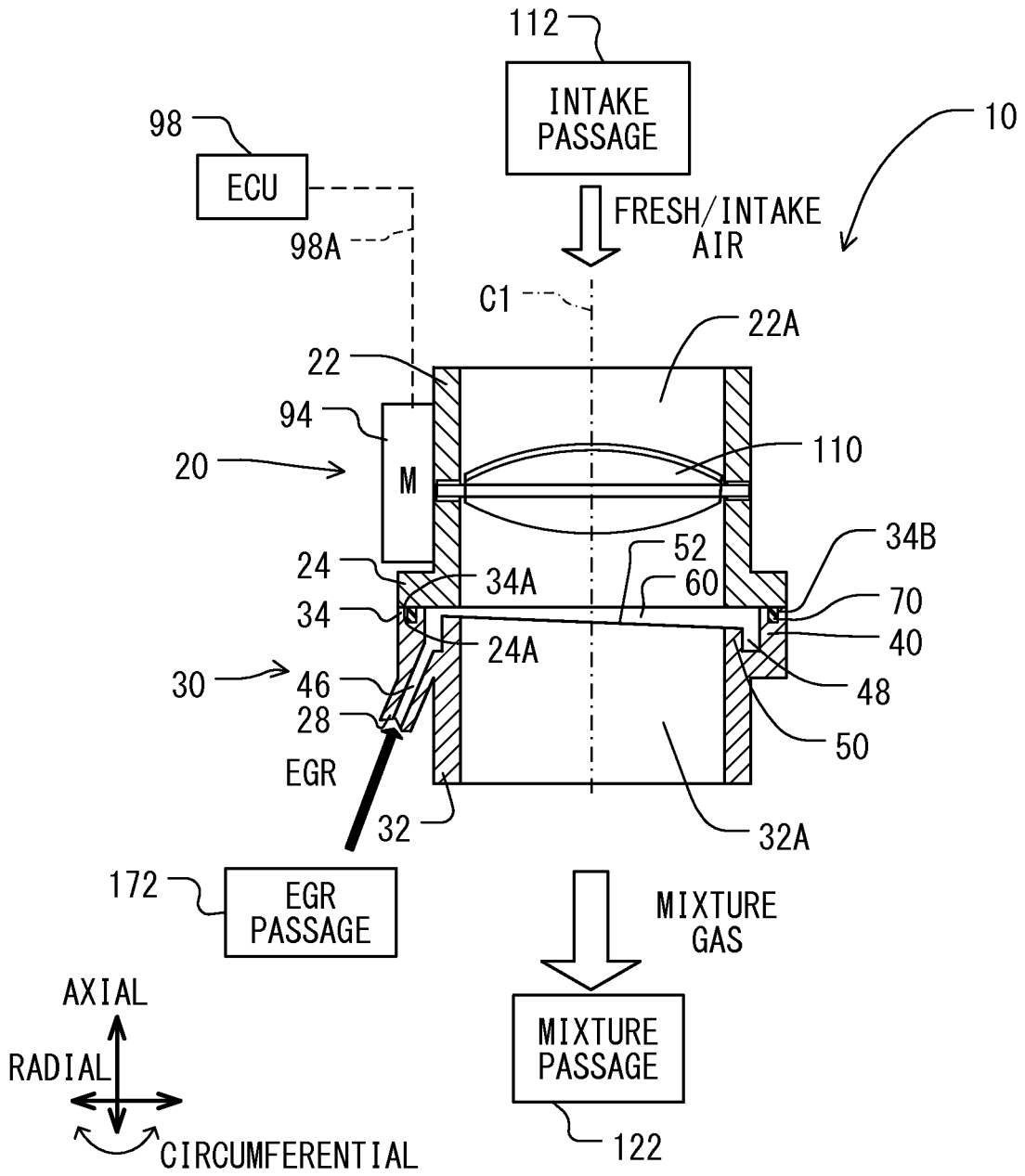
FIG. 2 is a schematic sectional view showing an EGR device for the EGR system, according to a first embodiment.

In the following description, a radial direction is along an arrow represented by "RADIAL" in drawing(s). An axial direction is along an arrow represented by "AXIAL" in drawing(s). A circumferential direction is along an arrow represented by "CIRCUMFERENTIAL" in drawing(s).

As follows, a first embodiment of the present disclosure will be described with reference to FIGS. 1 to 7. As shown FIG. 1, according to the present example, an internal combustion engine 150 has cylinders connected with an intake manifold 148 and an exhaust manifold 152.

The engine 150 is combined with an intake and exhaust system. The intake and exhaust system includes an intake passage 112, an EGR device 10, a mixture passage 122, a turbocharger including a compressor 130 and a turbine 160, a charge air passage 142, and an intercooler 140. The intake and exhaust system further includes a combustion gas passage 158, an exhaust passage 162, an EGR passage 172, an EGR cooler 180, and an EGR valve 90. The valve device 10 includes an intake valve 110.

The intake passage 112 is connected with the EGR device 10. The EGR device 10 is connected with the compressor 130 through the mixture passage 122. The compressor 130 is connected with the intake manifold 148 through the charge air passage 142. The charge air passage 142 is equipped with the intercooler 140. The exhaust manifold 152 is connected with the turbine 160 through the combustion gas passage 158. The turbine 160 is connected with the exhaust passage 162. The EGR passage 172 is branched from the exhaust passage 162 and connected with the EGR device 10. The EGR passage 172 is equipped with the EGR cooler 180.

The intake passage 112 conducts fresh/intake air from the outside of the vehicle into the EGR device 10. The intake valve 110 regulates a quantity of fresh/intake air flowing into the EGR device 10. The EGR device 10 draws fresh/intake air from the intake passage 112 and draws exhaust gas from the exhaust passage 162 through the EGR passage 172. The EGR device 10 includes an EGR mixer to blend the drawn fresh/intake air with the drawn exhaust gas to produce mixture gas. The mixture passage 122 conducts the mixture gas from the EGR device 10 into the compressor 130.

The compressor 130 is rotatably connected with the turbine 160 via a common axis. The compressor 130 is driven by the turbine 160 to compress the mixture gas. The charge air passage 142 conducts the compressed mixture gas to the intake manifold 148. The intercooler 140 is a heat exchanger to cool the compressed mixture gas conducted through the charge air passage 142.

The engine 150 draws the cooled mixture gas. The engine 150 forms air-fuel mixture with the drawn mixture gas and injected fuel in each cylinder and burns the air-fuel mixture in the cylinder to drive a piston in the cylinder. The engine 150 emits combustion gas (exhaust gas) through the exhaust manifold 152 into the combustion gas passage 158. The combustion gas passage 158 conducts the combustion gas into the turbine 160. The turbine 160 is driven by the exhaust gas to drive the compressor 130 thereby to cause the compressor 130 to compress mixture gas and to press-feed the compressed mixture gas through the charge air passage 142 and the intercooler 140 into the engine 150.

The exhaust passage 162 conducts exhaust gas (combustion gas) from the turbine 160 to the outside of the vehicle. The EGR passage 172 is branched from the exhaust passage 162 at the downstream side of the turbine 160 to recirculate a part of exhaust gas from the exhaust passage 162 into the EGR device 10. The EGR cooler 180 is a heat exchanger to cool exhaust gas flowing though the EGR passage 172 into the EGR device 10. The EGR device 10 is located at a connection among the intake passage 112, the EGR passage 172, and the mixture passage 122. The EGR passage 172 is merged with the intake passage 112 in the EGR device 10. The EGR valve 90 regulates a quantity of EGR gas recirculated into the EGR mixer.

As described above, the EGR system is configured to recirculate a part of exhaust gas from the exhaust passage 162 into the intake passage 112. The recirculated exhaust gas may contain oxygen at a lower percentage compared with oxygen contained in fresh/intake air. Therefore, recirculated exhaust gas may dilute mixture of exhaust gas and fresh/intake air thereby to reduce peak temperature of combustion gas when burned in the combustion chamber of the engine 150. In this way, the EGR system may reduce oxidization of nitrogen, which is caused under high temperature, thereby to reduce nitrogen oxide (NOx) occurring in the combustion chamber.

Subsequently, the configuration of the EGR device 10 will be described in detail. As shown in FIGS. 2 to 7, the EGR device 10 includes an inlet housing 20, an outlet housing 30, and the intake valve 110. The inlet housing 20, the outlet housing 30, and the intake valve 110 are formed of a metallic material such as stainless steel and/or an aluminum alloy.

The inlet housing 20 includes an air inlet 22 and an inlet flange 24. The air inlet 22 extends along a center axis C1 and defines an inlet inner passage 22A therein. The inlet flange 24 defines a flat surface 24A, which is perpendicular to the center axis C1. In the present example, the inlet flange 24 has the flat surface 24A entirely without protrusions and recesses.

The inlet housing 20 accommodates the intake valve 110. The intake valve 110 is, for example, a butterfly valve having a shaft, which is rotatably supported by the inlet housing 20 via bearings at both ends. Thus, the intake valve 110 is rotatably equipped in the inlet housing 20 and is variable in rotational position to control an opening area of the inlet inner passage 22A. The intake valve 110 is rotatable between a full close position to close the inlet inner passage 22A entirely and a full open position to open the inlet inner passage 22A entirely.

The inlet housing 20 is equipped with a motor actuator 94. The motor actuator 94 is connected with one end of the shaft to drive the intake valve 110. The motor actuator 94 includes, for example, an electric motor and reduction gears. An electronic control unit (ECU) 98 is electrically connected with the motor actuator 94 to control electricity supplied to the motor actuator 94 thereby to control the rotation angle of the intake valve 110. The motor actuator 94 may be equipped with a hall sensor (not shown) to detect the rotation angle and to send a signal representing the detected rotation angle to the ECU 98. The ECU 98 is configured to control the position of the intake valve 110 to manipulate a quantity of intake air flowing inside the inlet housing 20.

The outlet housing 30 includes an inner pipe 50, an outer pipe 40, an outlet 32, an EGR inlet 28, and an outlet flange 34. The outlet 32 extends along the center axis C1 and defines an outlet inner passage 32A therein.

The outer pipe 40 and the inner pipe 50 are each in a tubular shape. The outer pipe 40 is greater than the inner pipe 50 in inner diameter and is located on the outside of the inner pipe 50 in the radial direction. The outer pipe 40 and the inner pipe 50 form an annular passage 48 therebetween. In the present example, the outer pipe 40 and the inner pipe 50 are coaxial with each other.

The outlet flange 34 defines a flat surface 34A, which is perpendicular to the center axis C1. The outlet flange 34 has a rail 34B in an annular shape extending in the circumferential direction. The rail 34B accommodates a gasket 70. The gasket 70 is an annular shape and is formed of an elastic material. The EGR inlet 28 is in a pipe shape and extends from the outer pipe 40. The EGR inlet 28 is at an angle relative to the center axis C1. The EGR inlet 28 defines an EGR channel 46 therein. The outlet housing 30 may function as an EGR mixer.

Figure 5:
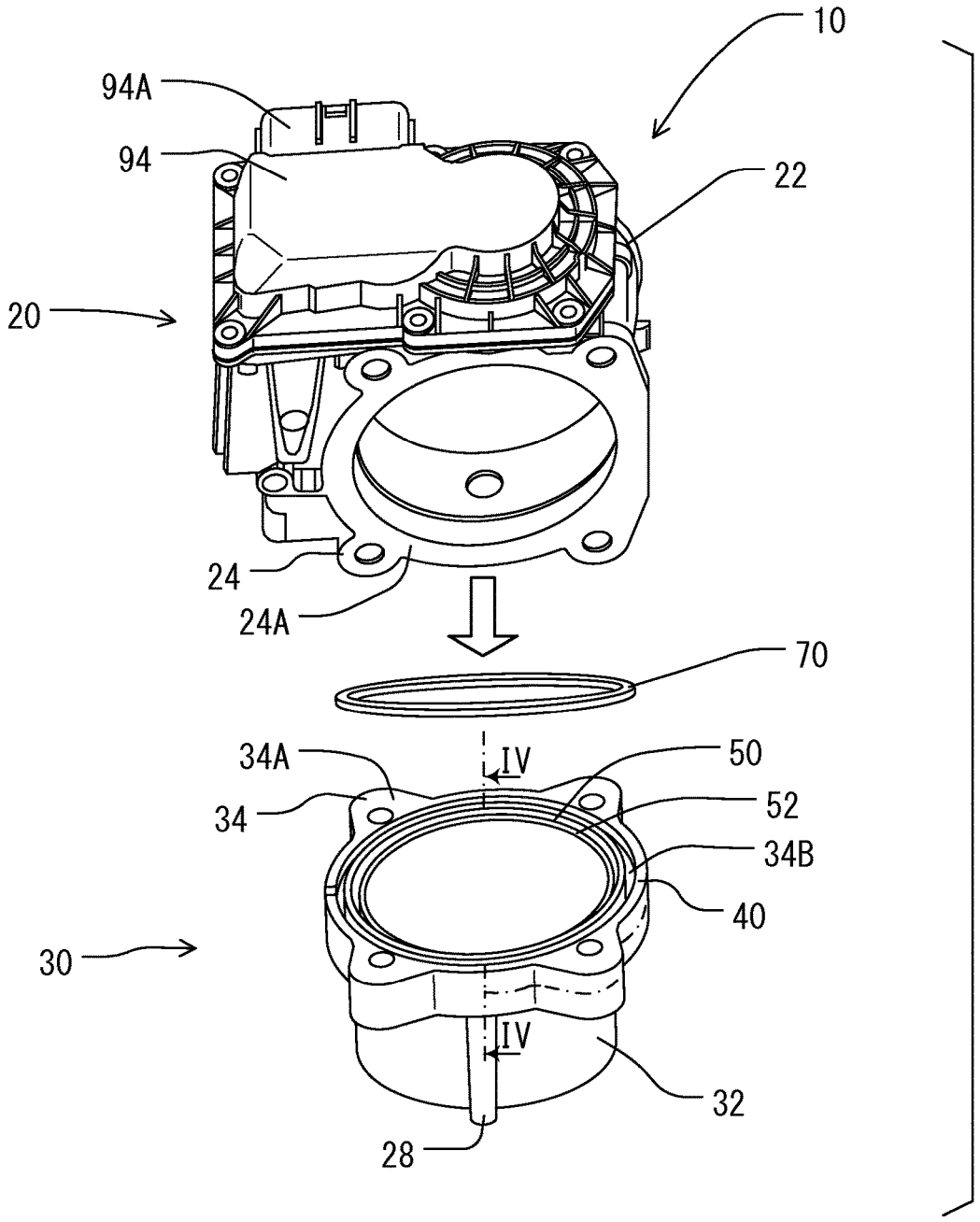
FIG. 5 is an exploded view showing the outlet housing, an inlet housing, and a gasket.
Figure 6:
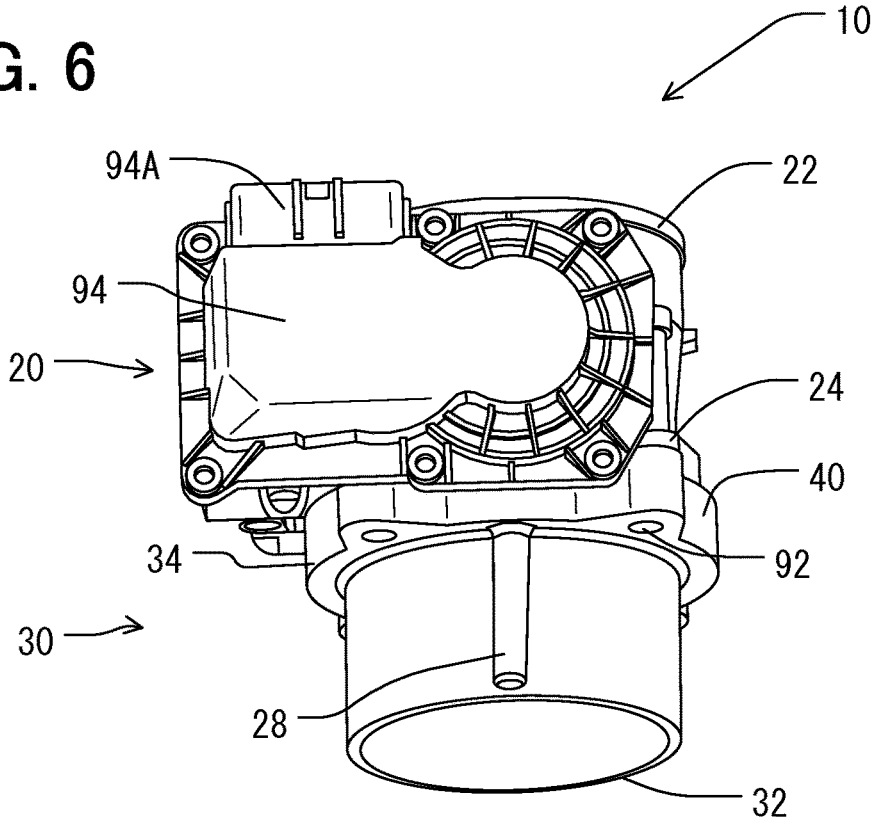
FIG. 6 is a perspective view showing the outlet housing and the inlet housing integrated with each other.

As shown in FIG. 5, the inlet flange 24 of the inlet housing 20 is connected with the outlet flange 34 of the outlet housing 30. More specifically, the flat surface 24A of the inlet flange 24 is abutted (mated) with the flat surface 34A of the outlet flange 34. In this way, as shown in FIG. 6, the inlet housing 20 and the outlet housing 30 are integrated into a singular housing. The inlet flange 24 and the outlet flange 34 have screw holes 92 through which bolts (none shown) are inserted and screwed to fasten the inlet flange 24 with the outlet flange 34. The motor actuator 94 has an electric connector 94A, which is to be connected with the ECU 98 (FIG. 2) through an electric wiring 98A.

In FIG. 5, the gasket 70 is equipped in the rail 34B of the outlet flange 34. The gasket 70 is elastically in contact with the flat surface 24A of the inlet flange 24 when the outlet housing 30 is integrated with the inlet housing 20. Thus, the gasket 70 seals a gap between the flat surface 24A of the inlet flange 24 and the flat surface 34A of the outlet flange 34.

Referring back to FIG. 2, the inlet housing 20 is connected with the intake passage 112 at the air inlet 22. The outlet housing 30 is connected with the mixture passage 122 at the outlet 32. The outlet housing 30 is further connected with the EGR passage 172 at the EGR inlet 28.

In the state in which the inlet housing 20 is connected to the outlet housing 30, the air inlet 22, the inner pipe 50, and the outlet 32 are aligned linearly. Thus, the inlet inner passage 22A and the outlet inner passage 32A extend linearly along the center axis C1.

The outer pipe 40 has an in inner diameter, which is greater than an inner diameter of each of the air inlet 22, the inner pipe 50, and the outlet 32. The inner pipe 50 has an outer periphery, which defines the annular passage 48 with an inner periphery of the outer pipe 40. The annular passage 48 is in an annular shape and extends in the circumferential direction. The annular passage 48 communicates with the EGR channel 46.

The inner pipe 50 has an end surface 52 opposed to the flat surface 24A of the inlet flange 24. The end surface 52 is inclined relative to the flat surface 34A of the outlet flange 34. The flat surface 24A of the inlet flange 24 and the end surface 52 form a throttle passage 60 therebetween. The throttle passage 60 is narrow on the side of the EGR channel 46 and is wide on the opposite side of the EGR channel 46.

Figure 3:
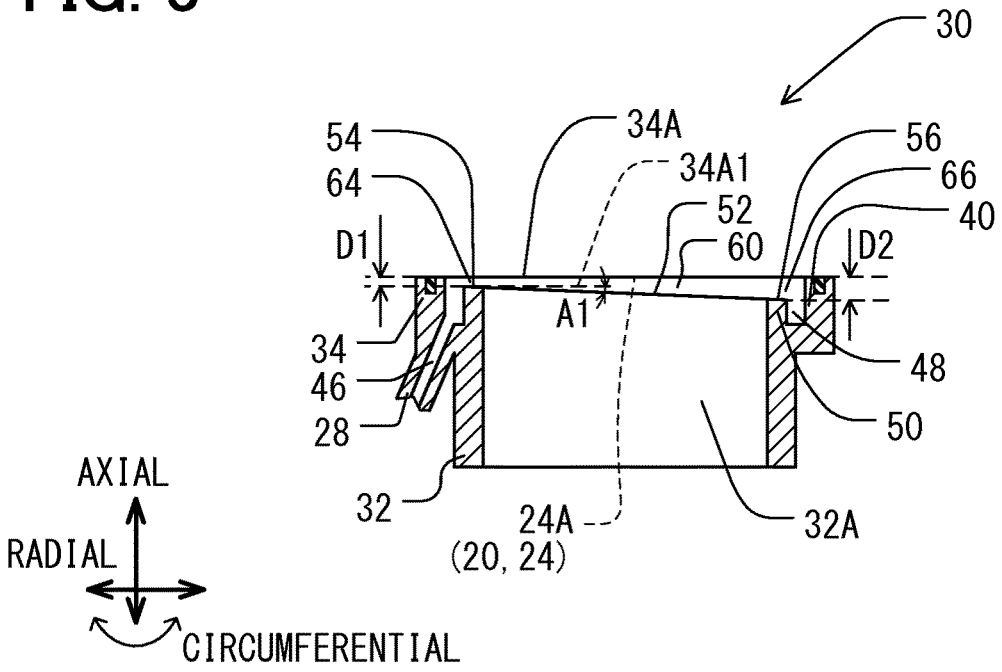
FIG. 3 is a schematic sectional view showing an outlet housing of the EGR device.
Figure 4:
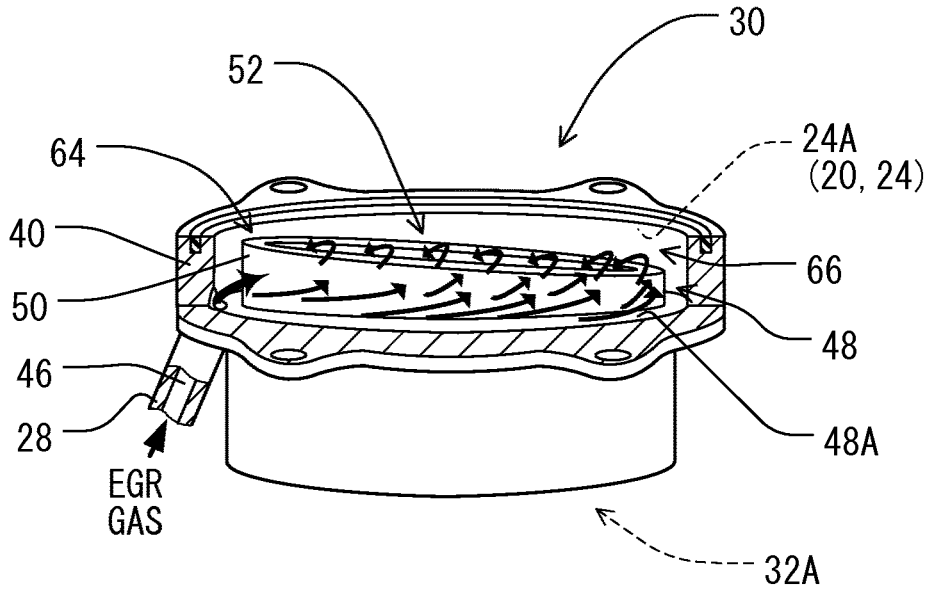
FIG. 4 is a schematic perspective view showing the outlet housing.

As follows, the configuration related to the throttle passage 60 will be described further in detail with reference to FIGS. 3 and 4. In FIGS. 3 and 4, the inlet housing 20 is omitted to simplify the illustrations, nevertheless, description will be made on assumption that the inlet housing 20 exists.

As shown in FIG. 3, the end surface 52 has an EGR end 54 and a counter EGR end 56. The EGR end 54 is located on the side of the EGR channel 46 and is close to the EGR channel 46. The counter EGR end 56 is located on the opposite side of the EGR channel 46 across the outlet inner passage 32A.

The EGR end 54 is at a distance D1 from the flat surface 34A of the outlet flange 34. The counter EGR end 56 is at a distance D2 from the flat surface 34A of the outlet flange 34. The distance D2 is greater than the distance D1. That is, the counter EGR end 56 is farther from the flat surface 34A of the outlet flange 34 than the EGR end 54. The end surface 52 is at an angle A1 relative to a dotted straight line 34A1, which is in parallel with the flat surface 34A of the outlet flange 34. That is, the end surface 52 is inclined at the angle A1 relative to the flat surface 34A of the outlet flange 34.

The throttle passage 60 includes a narrow passage 64 and a wide passage 66. Specifically, the EGR end 54 defines the narrow passage 64 with the flat surface 24A of the inlet housing 20. The counter EGR end 56 defines the wide passage 66 with the flat surface 24A of the inlet housing 20. The wide passage 66 is greater in area than the narrow passage 64 relative the axial direction. The throttle passage 60 gradually increases in area from the narrow passage 64 to the wide passage 66 along the circumferential direction.

FIG. 4 is a partial sectional view showing the outlet housing 30 taken along a line IV-IV in FIG. 5. In FIG. 4, the EGR channel 46 draws EGR gas into the outlet housing 30. The EGR gas flows out of the EGR channel 46 and enters the annular passage 48. Initially, the EGR gas is at a relatively high flow velocity having a relatively high kinetic energy. The EGR gas may partially flows through the narrow passage 64 radially inward into the outlet inner passage 32A. Remainder of EGR gas may partially collide against the outer periphery of the inner pipe 50. The latter EGR gas flow is divided into two flows in the circumferential direction along the outer periphery of the inner pipe 50. The divided flows of the EGR gas are induced along the annular passage 48. Thus, the EGR gas flows toward the opposite side of the EGR channel 46, while flowing through the throttle passage 60 radially inward into the outlet inner passage 32A.

While the EGR gas flows along the annular passage 48, the EGR gas flow may lose its kinetic energy gradually, and simultaneously, the throttle passage 60 increases in area toward the opposite side of the EGR channel 46 at the wide passage 66. That is, the throttle passage 60 initially inhibits inflow of the EGR gas, which is at relatively high flow velocity, at the narrow passage 64 on the side of the EGR channel 46. Subsequently, the throttle passage 60 gradually increases in area toward the opposite side of the EGR channel 46 to allow inflow of the EGR gas gradually, while the EGR gas flow loses kinetic energy gradually.

The increase in the area of the throttle passage 60 from the narrow passage 64 toward the wide passage 66 may be defined substantially to balance with decrease in the kinetic energy of the EGR gas flow. The balance between the increase in the area of the throttle passage 60 and the decrease in the kinetic energy of the EGR gas flow may enable to draw the EGR gas toward the opposite side of the EGR channel 46 while gradually inducing the EGR gas into the outlet inner passage 32A radially inward from the annular passage 48. Consequently, the EGR gas may be evenly distributed entirely in the annular passage 48 in the circumferential direction toward the opposite side of the EGR channel 46. In this way, the present configuration may enable homogenized distribution of EGR gas induced into the outlet inner passage 32A relative to the circumferential direction.

Figure 7:
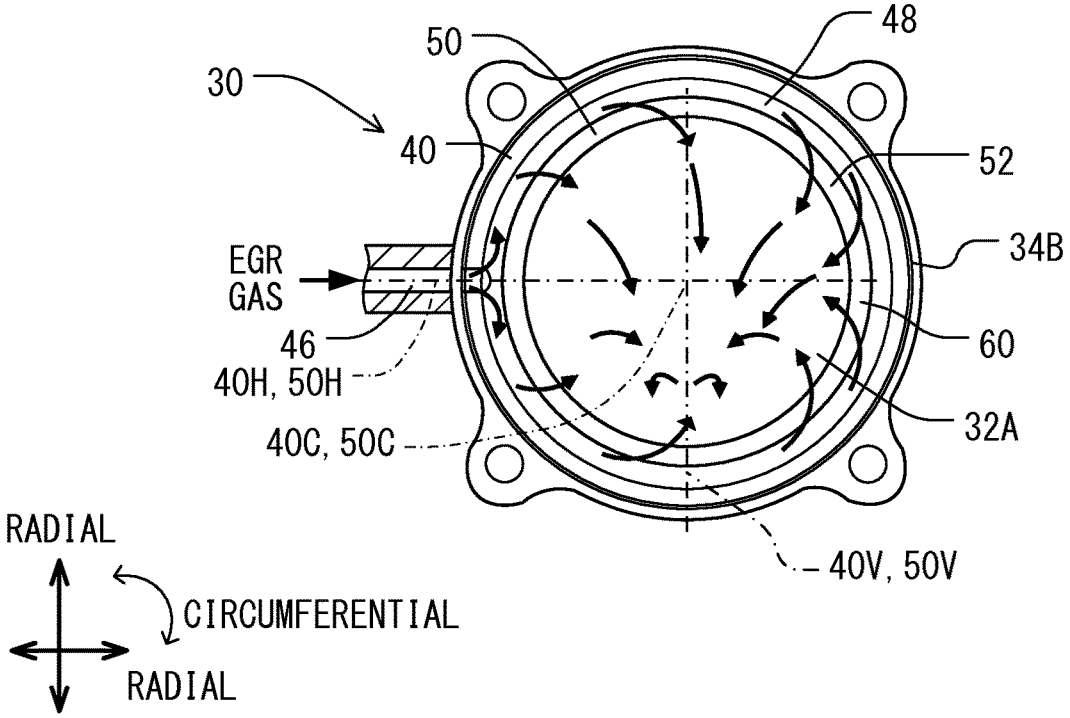
FIG. 7 is a schematic top view showing the outlet housing.

As shown in FIG. 7, the present configuration may enable to flow the EGR gas into the outlet inner passage 32A radially inward through the throttle passage 60. The annular passage 48 leads EGR gas to flow from the EGR channel 46 and to flow entirely around the outer periphery of the inner pipe 50 toward the opposite side of the EGR channel 46. Thus, the annular passage 48 may enable to distribute EGR gas evenly around the inner pipe 50 in the circumferential direction.

In FIG. 7, the inner pipe 50 has a vertical center 50V, a horizontal center 50H, and a center point 50C, which is an intersection between the vertical center 50V and the horizontal center 50H. The outer pipe 40 has a vertical center 40V, a horizontal center 40H, and a center point 40C, which is an intersection between the vertical center 40V and the horizontal center 40H. In the present example, the inner pipe 50 and the outer pipe 40 are substantially coaxial with each other. Specifically, the center point 50C of the inner pipe 50 and the center point 40C of the outer pipe 40 substantially coincide with each other.

Referring back to FIG. 5, the flat surface 34A of the outlet flange 34, the end surface 52 of the inner pipe 50, a bottom surface 48A of the annular passage 48 (FIG. 4) may be formed by machining work. Specifically, for example, the outlet flange 34 may be entirely grinded first to shape the flat surface 34A of the outlet flange 34. Subsequently, for example, the annular passage 48 may be formed by cutting the grinded surface to form the bottom surface 48A. Subsequently, for example, the end surface 52 of the inner pipe 50 may be shaped by cutting. These machining works may be implemented from one side of the outlet flange 34.

The flat surface 24A of the inlet flange 24 may be formed by machining work. Specifically, for example, the inlet flange 24 may be entirely grinded to shape the flat surface 24A of the inlet flange 24.

Second Embodiment

Figure 8:
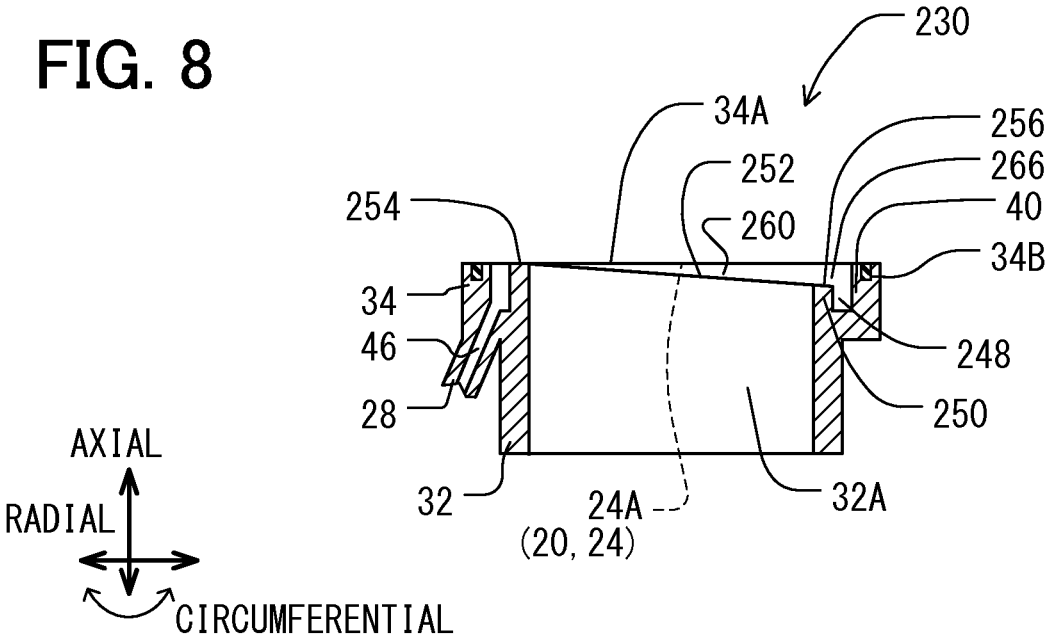
FIG. 8 is a schematic sectional view showing an outlet housing according to a second embodiment.

As shown in FIG. 8, according to the present second embodiment, an outlet housing 230 has an inner pipe 250 having an end surface 252. The end surface 252 includes an EGR end 254 and a counter EGR end 256. The counter EGR end 256 forms a wide passage 266 with the flat surface 24A of the inlet flange 24. The EGR end 254 is at the same level as the flat surface 34A of the outlet flange 34 and is in parallel with the flat surface 34A. The EGR end 254 is entirely in contact with the flat surface 24A of the inlet flange 24 to prohibit inflow of EGR gas from an annular passage 248 into the outlet inner passage 32A on the side of the EGR end 254. That is, the configuration of the second embodiment may not form the narrow passage 64 described in the first embodiment. A throttle passage 260 gradually increases in area from the immediately downstream side of the EGR end 254 toward the opposite side of the EGR channel 46.

The EGR end 254 may have a notch in, for example, semicircular shape to form a small passage communicating the annular passage 48 with the outlet inner passage 32A.

Third Embodiment

Figure 9:
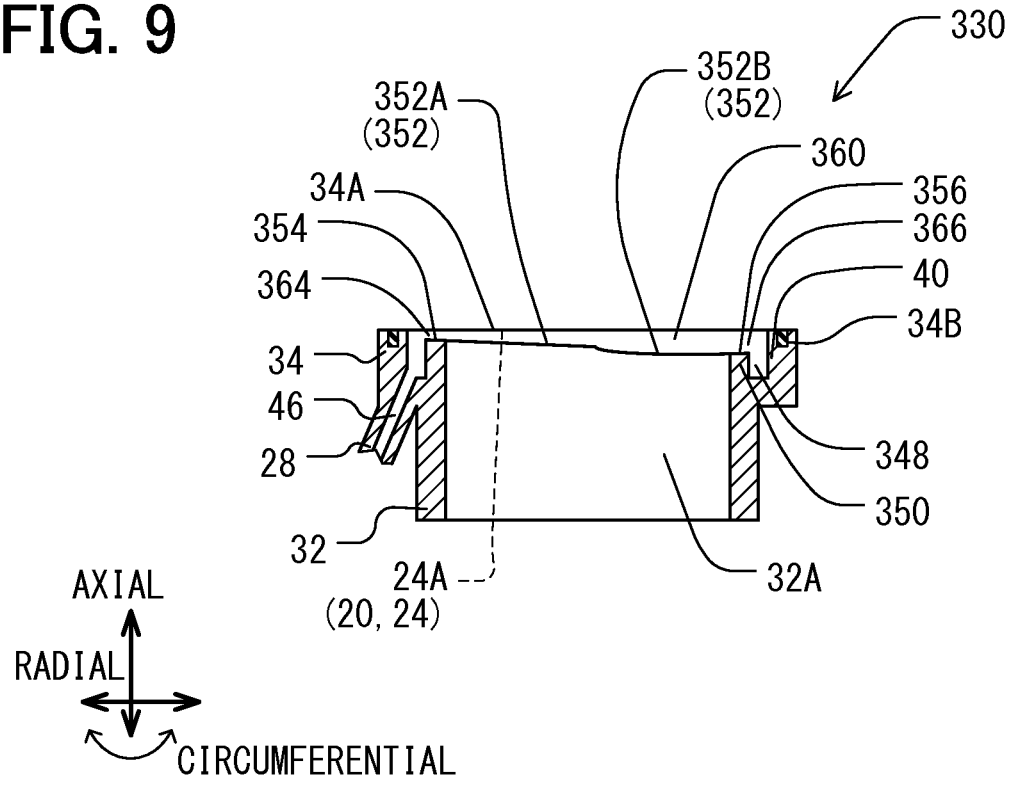
FIG. 9 is a schematic sectional view showing an outlet housing according to a third embodiment.

As shown in FIG. 9, according to the present third embodiment, an outlet housing 330 has an inner pipe 350 having an end surface 352 including two different surfaces. The two different surfaces include a tapered surface 352A and an arc surface 352B. The tapered surface 352A extends from the side of the EGR channel 46 to an intermediate portion of the inner pipe 350, such as a middle of the inner pipe 350. The arc surface 352B extends from the intermediate portion of the inner pipe 350 to the opposite side of the EGR channel 46. The arc surface 352B is convex toward the outlet inner passage 32A to increase a quantity of EGR gas drawn from an annular passage 348 on the opposite side of the EGR channel 46.

The combination of the two different surfaces and the intermediate portion of the inner pipe 350 may be arbitrarily determined according to, for example, distribution of EGR flow in the annular passage 348. In this way, a throttle passage 360 is formed in an ideal shape thereby to produce a homogenized distribution of the EGR gas.

The end surface 352 includes an EGR end 354 and a counter EGR end 356. The counter EGR end 356 forms a wide passage 366 with the flat surface 24A of the inlet flange 24. In the present embodiment, the EGR end 354 is distant from the flat surface 34A of the outlet flange 34 to form a narrow passage 364. The EGR end 354 may be in contact with the flat surface 34A of the outlet flange 34.

Other Embodiment

The inlet housing may have at least one of the outer pipe, the inner pipe, the EGR channel, the rail, and the gasket. The outlet housing may not have at least one of the outer pipe, the inner pipe, the EGR channel, the rail, and the gasket. Both the inlet housing and the outlet housing may have at least one of the outer pipe, the inner pipe. The outlet flange may have a flat surface entirely.

The end surface of the inlet pipe may be stepwise to increase the narrow passage from the side of the EGR channels toward the wide passage.

The outlet housing may include the intake valve and/or may be equipped with the motor actuator.

The EGR device may not have the intake valve. The intake valve may be equipped separately from the EGR device. The intake valve and/or the EGR valve may be equipped downstream the turbocharger.

The inner pipe may have an end surface in various shapes opposed to an opposite surface to form a throttle passage.

The inner pipe may be offset relative to the outer pipe, such that the vertical center of the outer pipe is offset from the vertical center of the inner pipe in the radial direction. More specifically, the outer pipe and the inner pipe may be offset in relation to each other so that a distance between the outer pipe and the inner pipe progressively decreases from the EGR channel to the opposite side of the EGR channel. In this case, an annular passage formed between the outer pipe and the inner pipe may be gradually reduced in passage area toward the opposite side of the EGR channel.

The air inlet may have an inlet inner passage in a tapered shape reduced toward a downstream side, and the outlet may have an outlet inner passage in a tapered shape widened toward the downstream side, thereby to throttle the passage and to cause Venturi effect. The present configuration may be configured to increase flow velocity of fresh/intake air and to cause negative pressure at the throttle passage, thereby to facilitate to induce EGR gas from the annular passage on the radially outside of the inner pipe into the outlet inner passage through the throttle passage. In this way, EGR gas may be fed into the outlet inner passage and blended with fresh/intake air.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An EGR device comprising:

a housing comprising an inlet housing and an outlet housing joined together to define a flat mating surface at an inlet housing end surface;

the outlet housing comprising:

a first side, a second side which is opposite the first side across a center longitudinal axis of the outlet housing, an outlet flange defining an outer pipe, an inner pipe, an annular passage between the outer pipe and the inner pipe, and an EGR inlet;

wherein the inner pipe defines an inner passage therein through which air flows along the center longitudinal axis, the EGR inlet is disposed on the first side and defines an EGR channel therein, the EGR channel fluidly communicating an area outside of the housing with the annular passage, the inner pipe has an inner pipe end surface spaced from the inlet housing end surface to define a throttle passage therebetween through which the annular passage is in fluid communication with the inner passage, and the inner pipe end surface is sloped relative to the flat mating surface such that the throttle passage gradually widens from the first side to the second side.

2. The EGR device according to claim 1, wherein the inner pipe end surface includes a flat surface portion corresponding to a linear widening of the throttle passage and an arc surface portion corresponding to a nonlinear widening of the throttle passage.

3. The EGR device according to claim 1, wherein the inlet housing has an inlet flange, and the inlet flange is abutted to the outlet housing to form the throttle passage therebetween.

4. The EGR device according to claim 3, wherein the outlet flange is integrated with the outer pipe and the inner pipe, and the inlet flange, the outlet flange, the outer pipe, and the inner pipe form the annular passage and the throttle passage thereamong.

5. The EGR device according to claim 4, wherein the outlet flange has a rail accommodating a gasket.

6. The EGR device according to claim 5, wherein the inlet flange has a flat surface entirely.

7. The EGR device according to claim 4, wherein the outlet flange is integrated with the outer pipe and the inner pipe.

8. The EGR device according to claim 1, further comprising:

a valve movable in one of the inlet housing and the outlet housing.

9. The EGR device according to claim 1, wherein the throttle passage is located radially inside the annular passage.

10. The EGR device according to claim 9, wherein the throttle passage extends circumferentially along the inner pipe end surface.

* * * * *